US005197209A

United States Patent [19]

Rolland et al.

[11] Patent Number: 5,197,209

[45] Date of Patent: Mar. 30, 1993

[54] DEVICE FOR OPENING AND CLOSING A SKI BOOT

[75] Inventors: James Rolland, Saint Jorioz; Jean-Marie Begey, Bonne; Eric Marguet, Annecy; Michel Mabboux, Seynod, all of France

[73] Assignee: Salomon S. A., Chavanod, France

[21] Appl. No.: 650,609

[22] Filed: Feb. 5, 1991

[30] Foreign Application Priority Data

Feb. 5, 1990 [FR] France ..... 90 01286

[51] Int. Cl.[5] ..... A43B 5/04

[52] U.S. Cl. ..... 36/117; 36/120

[58] Field of Search ..... 36/147, 118, 119, 120, 36/121

[56] References Cited

U.S. PATENT DOCUMENTS

| | | | |
|---|---|---|---|
| D. 272,484 | 2/1984 | Sartor | 36/117 |
| 4,551,93 | 11/1985 | Morell et al. | 36/120 |
| 4,602,443 | 7/1986 | Spademan | 36/120 |
| 4,633,599 | 1/1987 | Morell et al. | 36/117 |
| 4,793,076 | 12/1988 | Hilgarth | 36/120 |
| 4,879,822 | 11/1989 | Hayes | 36/119 |
| 4,922,635 | 5/1990 | Zanco | 36/117 |
| 4,949,480 | 8/1990 | Hercog et al. | 36/119 |

FOREIGN PATENT DOCUMENTS

| | | | |
|---|---|---|---|
| 119566 | 5/1986 | European Pat. Off. . | |
| 3247516 | 11/1984 | Fed. Rep. of Germany | 36/120 |
| 2450574 | 3/1979 | France . | |

*Primary Examiner*—Jimmy G. Foster
*Assistant Examiner*—Marie Denise Patterson
*Attorney, Agent, or Firm*—Pollock, Vande Sande & Priddy

[57] ABSTRACT

Device for opening and closing a rear-entry ski boot, by simultaneous rotation of front and rear portions of the upper without raising the front portion. The rear portion rotates on the shell base about a hinge pin, and the front portion about a pivot axis at the front end of the shell base. The front and rear portions are joined to each other by a pin-and-slot connection located in overlapping extensions of these elements.

12 Claims, 1 Drawing Sheet

DEVICE FOR OPENING AND CLOSING A SKI BOOT

FIELD OF THE INVENTION

The present invention relates to a device for opening and closing a rear-entry boot, especially a ski or hiking boot.

BACKGROUND OF THE INVENTION

For a number of well-known reasons, ski boots comprise a rigid shell comprising a sole and a shell base surmounted by an upper which may or may not be articulated on the shell base. The upper and shell base may be composed of different separate elements, depending o various structure manufacturing methods.

These boots must meet at least two requirements: they must give the skier good performance by transmitting his orders as faithfully as possible to the ski; and they must also be comfortable. But the rigidity of the shell often makes it difficult, indeed painful, to put on and take off the boots. Very often, the shape imparted to the shell is preferably that of a closed boot, thereby requiring that the various components of the upper be separated, simultaneously if possible, an operation which is not always easily accomplished to allow the boot to be put on and taken off.

SUMMARY OF THE INVENTION

The invention is intended to address this problem and offers a device for opening the ski boot in which the opening of a rear cover causes the opening of a front part of this boot.

In accordance with Patent No. EP 119 566, it is known how to manufacture boots of this type. In this patent, the pivoting of a rear cover around its hinge pin on the shell base simultaneously causes the forward pivoting of a sleeve by means of a movement of elevation and then of rotation. This boot further comprises on its front part a cover which slides along the longitudinal dimension of the boot when the rear cover is opened, while the sleeve causes a limited boot opening movement.

The invention relates to a device which gives a wide opening by simple simultaneous rotation of a front piece and of a rear cover of a boot without raising the front part of this boot. Another object of the invention is to simplify the kinematics of the moving components making up the boot, while ensuring proper operation when in use and reduced manufacturing cost.

The object of the invention is a device for opening and closing a rear-entry ski boot comprising a shell base surmounted by an upper extending from the end into the area enclosing the skier's lower leg, this upper comprising at least one front piece extending over the front part of the foot and a rear cover or spoiler enclosing the rear part of skier's lower leg and jointed to the shell base. The spoiler is mounted in combination so as to rotate on the shell base around a hinge pin, the front piece being jointed on the front end of the shell base around a pivot axis and the spoiler and front piece being jointed one on the other in such a way that pivoting of the spoiler or of the front part causes reverse pivoting of the front piece or of the spoiler, respectively.

The device additionally includes the following features:

- The spoiler and front piece extend on each side of the boot in relation to the median plane and partially overlap, and they comprise on the overlapping portions an oblong slot and a connection finger designed to slide in the slot, the slot and finger constituting the joint between the spoiler and the front piece.
- The slot is formed in the extension of the spoiler, the connection finger being carried by the front piece.
- The slot is formed in the front piece, the connection finger being carried by the spoiler extension.
- The shell base comprises laterally, on each side of the median plane, at least one stop which limits the pivoting of the components of the upper during front-to-back flexion movements.
- The stop comes to be supported on the lateral extension of the spoiler and/or of the front piece.
- The distance between the hinge pin of the spoiler and the pivoting-limitation stop is substantial and determines the length of a stiffening beam designed for control of the front-to-back flexion.
- The rear area or sleeve of the front piece may be separate from the front area of the front cover of this front piece. This sleeve is mounted so as to allow rotation on the spoiler hinge pin, the joint between the front cover and the spoiler being located substantially in the area of the instep.
- The sleeve comprises laterally, on each side of the median plane, a downward extension in which an oblong slot is formed concentric to the joint of the front piece and through which the hinge pin of the spoiler passes, thereby allowing this front piece to pivot.
- The hinge pin of the spoiler is installed toward the front at the level of the instep, and the slot is placed above this pin.

BRIEF DESCRIPTION OF THE DRAWINGS

To enable the invention to be more clearly understood, three embodiments of the boot according to the invention are represented by way of example in the attached drawings, in which.

DESCRIPTION OF THE PREFERRED EMBODIMENTS

Figure 1:
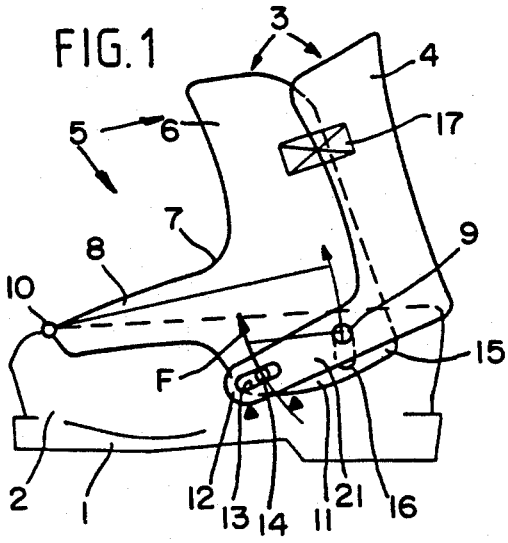
FIG. 1 is a schematic lateral view of the boot according to the invention, in the closed position.

The boot comprises, in ascending order, a sole 1 and a shell base 2 surmounted by an upper 3. The upper comprises a rear cover 4, commonly called a spoiler, and a front piece 5.

The sleeve 6 is formed by a vertical portion which covers the instep 7 and the tibia and is locked in place on the rear cover 4.

Figure 2:
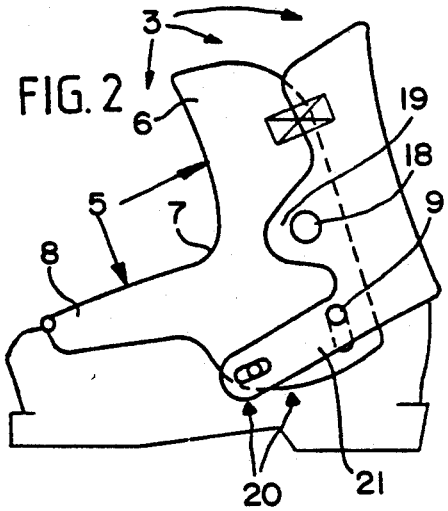
FIG. 2 illustrates a mechanism for locking the elements forming the upper of the boot in FIG. 1.

According to the invention, in the embodiment of FIGS. 1 and 2, the sleeve 6 is prolonged frontward by a front cover 8 which covers the front part of the foot in the case of a one-piece structure of the front piece 5.

Each of the elements 4 and 5 of the upper surrounds the shell base and is approximately symmetrical in relation to the vertical median plane of the boot.

According to the invention, the front piece 5 is jointed on the shell base 2 at the front end of the boot and pivots around the transverse pin 10. This piece comprises laterally a downward-sloping front extension 11.

The spoiler 4 is mounted so as to rotate on the shell base 2 around a pin 9. It also comprises laterally an extension 12 extending frontward which covers at least partially the extension 11 of the front piece.

According to the invention, extensions 11 and 12 of the front piece and of the spoiler are jointed one to the other in such a way that pivoting of one of the two elements 4, 5 of the upper causes reverse pivoting of the opposite element, and vice-versa.

In the embodiment shown, the spoiler comprises an oblong slot 13 in which a connection finger 14 unitary with the front piece 5 slides. When the spoiler 4 pivots rearward, the slot describes the arc of a circle indicated by the arrow F. Simultaneously, the finger 14 pivots around the pin 10 while sliding in the slot 13, and the front piece 5 pivots frontward, thus opening the boot by moving each of the elements 4, 5 of the upper away from the other.

The front piece also extends rearward and downward at 15 and comprises an oblong slot centered on the hinge pin 10, through which the pivot pin 9 of the spoiler passes. This arrangement helps to control the pivoting motion and, if needed, the flexion of the front piece and its solidity and immobilization in the open or closed position.

Locking of the front piece and of the spoiler constituting the elements of the upper is effected using any conventional means 17. Furthermore (FIG. 2), pins 18 may be placed laterally on the front piece so as to pass through the spoiler in the area of the lateral extensions 19 provided for this purpose. In this embodiment, opening the boot requires that the walls of the spoiler be spread apart to disconnect the front piece. These pins constitute elements designed to stiffen the upper at the moment when the latter is locked in place.

According to the invention, at least one stop 20 is provided laterally on the shell base 2 in order to limit the pivoting of elements 4 and 5 of the upper during front-to-back flexion. In the example illustrated in FIGS. 1 and 2, two stops restrict the pivoting of the spoiler 4 and of the front piece 5.

Furthermore, the stop 20 is positioned at a substantial distance from the hinge pin 9 of the spoiler, so as to form between said pin and the stop itself a preferred area of control of front-to-back flexion. This area forms a stiffening beam 21 which resists bending during the flexion movements executed by the skier, this resistance being a function of the material used and of its shape.

Figure 3:
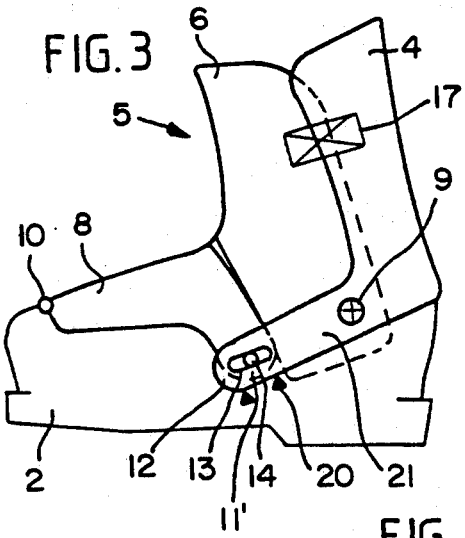
FIGS. 3 and 4 are schematic lateral views of a second embodiment of the invention.
Figure 4:
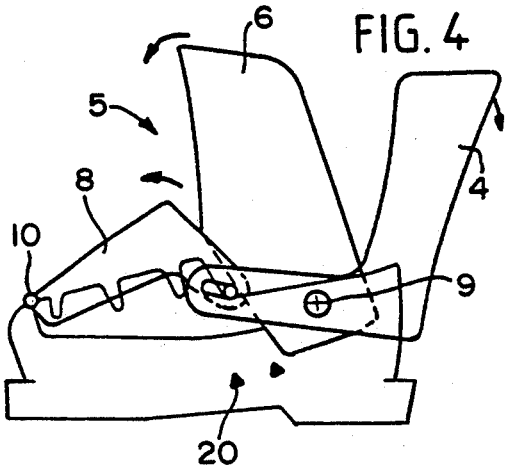

According to the embodiment shown in FIGS. 3 and 4, the sleeve 6 is limited to the vertical portion of the front piece 5 and protects the tibia by extending downward until it reaches approximately the instep 7. The front cover 8 is independent of the sleeve 6 and covers the front part of the foot while extending rearward until it reaches the instep area 7. The front cover 8 comprises a downward-sloping extension bearing the connection finger 14 which passes through an oblong slot 13 cut out of the end of the extension 12 of the spoiler.

The joint 13, 14 between the spoiler 4 and the cover 8 is preferably located substantially in the area beneath the instep.

The sleeve 6, which is independent of the front cover 8, is mounted so as to rotate on the shell base around the same hinge pin 9 of the spoiler. Thus, pivoting of the spoiler 4 simultaneously causes pivoting of the front cover 8, and vice-versa. When the boot is opened after the two elements 4, 8 pivot, the sleeve is easily made to pivot frontward, so as to enlarge the opening used to put on and take off the boot.

Furthermore, the front cover 8 may comprise means (not shown) for holding the front part of the foot in place. In this case, the frontward pivoting of the front cover 8 thus also releases any pressure exerted by these means on the front part of the foot.

As can be seen in these first two embodiments, the extension 12 of the spoiler is substantially perpendicular to the axis of the leg and forms an L.

As in the first embodiment, the shell base 2 comprises at least one stop 20 which restricts the pivoting of the spoiler and of the hood. In this second embodiment, the stop, by pressing against the cover, advantageously restricts the crushing action exerted by the latter on the foot.

Figure 5:
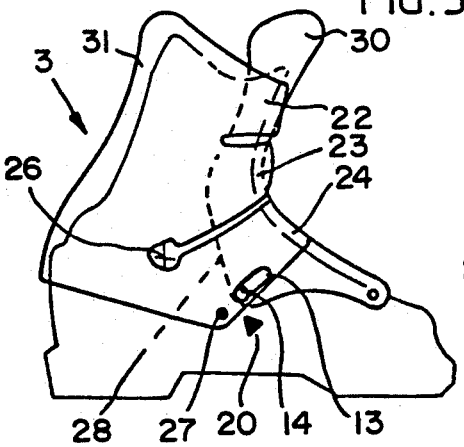
FIGS. 5 and 6 are lateral schematic views of a third embodiment of the invention.
Figure 6:
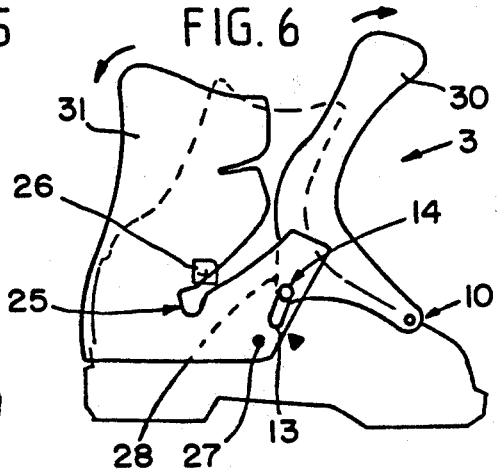

According to the embodiment illustrated in FIGS. 5 and 6, the upper 3 is formed of two elements: a front piece, called a tongue 30 in this instance, extending from the top of the upper to a spot on the front part of the foot and comprising smaller lateral extensions 28, and a rear cover, commonly called in this case a collar 31, which encloses the lower leg up to the front area corresponding to the instep. The rear cover conventionally incorporates locking means 22, 23, 24 comprising hooks or other devices and indentations 25 designed to house pins 26 located on the lateral walls of the shell base, these pins being elements which help to achieve the locking and stiffening of the upper.

The hinge pin 27 joining the collar 31 to the shell base according to the invention is installed toward the front, approximately at a level lower than the instep. On each side of the collar 31 above its hinge pin 27, an oblong slot 13 is formed in which the finger 14 carried by the tongue 30 slides.

To open the upper, the locking devices 22, 23, 24 and the pins 26 are released by spreading the collar 31 apart manually. One of the two elements 30, 31 of the upper is then made to pivot, thereby causing the pivoting of the other element. The reverse operation closes the upper.

This embodiment also calls for at least one flexion-control stop, on which the collar is supported.

In the preceding description, the slots 13 are formed in the lateral extensions of the collar 31 and the connection fingers are borne by the tongue 30. The invention also concerns a reverse mounting of these fingers on this type of boot.

What is claimed is:

1. Device for opening and closing a rear-entry ski boot comprising a sole and a shell base surmounted by an upper extending from an end of said shell base to an area enclosing a lower leg of a skier, said upper comprising at least one front piece (5) extending over a front portion of a foot and a rear cover (4), or spoiler, enclosing a rear portion of said lower leg and articulated to said shell base (2), said spoiler (4) being mounted for rotation on said shell base (2) about a hinge pin (9), said front piece (5) being articulated to a front end of said shell base (2) about a pivot pin (10), and comprising means forming a connection between said spoiler and said front piece in such a way that pivoting movement of said spoiler (4) and of said front piece (5), respectively, causes reverse pivoting movement of said front piece (5) and of said spoiler (4), said spoiler (4) and said front piece (5) being prolonged on each side of said boot by partly overlapping lateral extensions (11, 12), said extensions (11, 12) comprising respectively on overlapping portions of said spoiler and said front piece an oblong slot (13) and a connection finger (14) forming said connection between said spoiler (4) and said front piece (5), and said shell base comprising laterally, on each side, at least one stop (20) restricting pivoting of elements of said upper (4, 5) and preventing said connection (4, 5) from entraining said elements from reverse pivoting during front-to-back flexion.

2. Device according to claim 1, wherein said slot is located in said extension (12) of said spoiler, and said connection finger (14) is carried by said extension (11) of said front piece (5).

3. Device according to claim 1, wherein said slot is formed in said front piece (5), and said connection finger (14) is carried by said extension (11) of said spoiler.

4. Device according to claim 1, wherein said stop (20) provides support by pressing on said lateral extensions (11, 12) of said spoiler (4) and said front piece (5) during front-to-rear flexion from said upper (3).

5. Device according to claim 1, comprising a stiffening beam (21) designed to control front-to-rear flexion extending between said hinge pin (9) of said spoiler and said stop (20).

6. Device according to claim 1, wherein a rear zone of said front piece (5) comprises a sleeve (6) independent of a front cover (8) constituting a front area of said front piece (5), said sleeve (6) being mounted for rotation about said hinge pin (9) of said spoiler, the connection (13, 14) between said front cover (8) and said spoiler (4) being located in an instep area of said boot.

7. Device according to claim 1, wherein said front piece has a unitary structure, said sleeve (6) being extended frontwardly by a front cover (8) and comprising laterally, on each side, a downward-sloping extension (15) which contains an oblong slot (16) concentric with the joint (10) of said front cover and through which said hinge pin of said spoiler passes, thus allowing pivoting of said front cover.

8. Device according to claim 1, wherein said hinge pin of said spoiler is located toward the front and at a level of an instep of said foot, and said slot (13) is located above said hinge pin.

9. Device for opening and closing a rear-entry ski boot comprising a sole and a shell base surmounted by an upper extending from an end of said shell base to an area enclosing a lower leg of a skier, said upper comprising at least one front piece (5) extending over a front portion of a foot and a rear cover (4), or spoiler, enclosing a rear potion of said lower leg and articulated to said shell base (2), said spoiler (4) being mounted for rotation on said shell base (2) about a hinge pin (9), said front piece (5) being articulated to a front end of said shell base (2) about a pivot pin (10), and comprising means forming a connection between said spoiler and said front piece in such a way that pivoting movement of said spoiler (4) and of said front piece (5), respectively, causes reverse pivoting movement of said front piece (5) and of said spoiler (4), wherein, on each side of said boot, said spoiler (4) and said front piece (5) are prolonged by partly overlapping lateral extensions (11, 12), said extensions (11, 12) comprising respectively on overlapping portions of said spoiler and said front piece an oblong slot (13) and a connection finger (14) forming a connection between said spoiler (4) and said front piece (5), and wherein said shell base comprises laterally, on each side, at least one stop (20) restricting pivoting of elements of said upper (4, 5) and preventing said connection (4, 5) from entraining said elements from reverse pivoting during front-to-back flexion, a stiffening beam (21) being provided to control front-to-rear flexion extending between said hinge pin (9) of said spoiler and said stop (20).

10. Device for opening and closing a rear-entry ski boot comprising a sole and a shell base surmounted by an upper extending from an end of said shell base to an area enclosing a lower leg of a skier, said upper comprising at least one front piece (5) extending over a front portion of a foot and a rear cover (4), or spoiler, enclosing a rear portion of said lower leg and articulated to said shell base (2), said spoiler (4) being mounted for rotation on said shell base (2) about a hinge pin (9), said front piece (5) articulated to a front end of said shell base (2) about a pivot pin (10), and comprising means forming a connection between said spoiler and said front piece in such a way that pivoting movement of said spoiler (4) and of said front piece (5), respectively, causes reverse pivoting movement of said front piece (5) and of said spoiler (4), wherein on each side f said boot, said spoiler (4) and said front piece (5) are prolonged by partly overlapping lateral extensions (11, 12), said extensions (11, 12) comprising respectively on overlapping portions of said spoiler and said front piece an oblong slot (13) and a connection finger (14) forming a connection between said spoiler (4) and said front piece (5), and wherein a rear zone of said front piece (5) comprises a sleeve (6) independent of a front cover (8) constituting a front area of said front piece (5), said sleeve (6) being mounted for rotation about said hinge pin (9) of said spoiler, the connection (13, 14) between said front cover (8) and said spoiler (4) being located in an instep area of said boot.

11. Device for opening and closing a rear-entry ski boot comprising a sole and a shell base surmounted by an upper extending from an end of said shell base to an area enclosing a lower leg of a skier, said upper comprising at least one front piece (5) extending over a front portion of a foot and a rear cover (4), or spoiler, enclosing a rear portion of said lower leg and articulated to said shell base (2), said spoiler (4) being mounted for rotation on said shell base (2), about a hinge pin (9), said front piece (5) being articulated to a front end of said shell base (2) about a pivot pin (10), and comprising means forming a connection between said spoiler and said front piece in such way that pivoting movement of said spoiler (4) and of said front piece (5), respectively, causes reverse pivoting movement of said front piece (5) and of said spoiler (4), wherein said front piece has a unitary structure, said sleeve (6) being extended frontwardly by a front cover (8) and comprising laterally, on each side, a downward-sloping extension (15) which contains an oblong slot (16) concentric with the joint (10) of said front cover and through which said hinge pin of said spoiler passes, thus allowing pivoting of said front cover.

12. Device for opening and closing a rear-entry ski boot comprising a sole and a shell base surmounted by an upper extending from an end of said shell base to an area enclosing a lower leg of a skier, said upper comprising at least one front piece (5) extending over a front portion of a foot and a rear cover (4), or spoiler, enclosing a rear portion of said lower leg and articulated to said shell base (2), said spoiler (4) being mounted for rotation on said shell base (2) about a hinge pin (9), said front piece (5) being articulated to a front end of said shell base (2) about a pivot pin (10), and comprising means forming a connection between said spoiler and said front piece in such a way that pivoting movement of said spoiler (4) and of said front piece (5), respectively, causes reverse pivoting movement of said front piece (5) and of said spoiler (4), wherein, on each side of said boot, said spoiler (4) and said front piece (5) are prolonged by partly overlapping lateral extensions (11, 12), said extensions (11, 12) comprising respectively on overlapping portions of said spoiler and said spoiler and said front piece an oblong slot (13) and a connection finger (14) forming a connection between said spoiler (4) and said front piece (5), and wherein said hinge pin of said spoiler is located toward the front and at a level of an instep of said foot, and said slot (13) is located above said hinge pin.

* * * * *